US005114679A

United States Patent [19]

Reifler et al.

[11] Patent Number: 5,114,679

[45] Date of Patent: May 19, 1992

[54] METHOD OF USING A PIPETTE

[75] Inventors: Angela H. Reifler, Spencerport; Norbert S. Norkus, Webster, both of N.Y.

[73] Assignee: Eastman Kodak Company, Rochester, N.Y.

[21] Appl. No.: 572,576

[22] Filed: Aug. 27, 1990

[51] Int. Cl.[5] ..... B01L 3/02

[52] U.S. Cl. ..... 422/100; 422/101; 73/864.11

[58] Field of Search ..... 422/100, 101; 73/864.11; 128/767, 768

[56] References Cited

U.S. PATENT DOCUMENTS

| | | | |
|---|---|---|---|
| 917,442 | 4/1909 | Hutchinson | 73/864.11 |
| 1,589,056 | 7/1925 | Drummond | 422/100 |
| 2,423,173 | 3/1945 | Brady et al. | 422/100 |
| 2,655,152 | 10/1953 | Turner et al. | 128/765 |
| 3,181,529 | 5/1965 | Wilburn | 128/764 |
| 3,698,561 | 10/1972 | Babson | 210/445 |
| 4,014,653 | 3/1977 | Gianos et al. | 422/100 |
| 4,779,768 | 10/1988 | St. Amand | 73/864.11 |

FOREIGN PATENT DOCUMENTS

WO8600704 1/1986 PCT Int'l Appl. .

*Primary Examiner*—Robert J. Warden
*Assistant Examiner*—Laura E. Collins
*Attorney, Agent, or Firm*—Dressler, Goldsmith, Shore, Sutker & Milnamow, Ltd.

[57] ABSTRACT

A method of using a pipette comprising a flexible tube portion having an integrally formed squeezable bulb portion, a spring clip arranged between the ends of the pipette to inhibit air from being aspirated into the pipette and a filter at the inlet end of the pipette.

4 Claims, 1 Drawing Sheet

METHOD OF USING A PIPETTE

FIELD OF THE INVENTION

This invention relates to a method and apparatus for obtaining samples of biological fluid, for example, urine, for testing purposes.

BACKGROUND OF THE INVENTION

Many diagnostic tests require prior filtration as a preliminary step. Filtration has been accomplished by use of filter paper, a funnel and a collection vessel. Plastic tubes with fibrous filters at one end thereof have also been used. With a plastic pipette liquid is delivered into the filtering tube by squeezing the tube or a portion thereof and releasing the pressure.

There is an ongoing need for new and improved filtering devices for diagnostic use. Filtration of a fluid, as a pretreatment prior to application to a diagnostic test device, may necessitate the need for the end user to either disassemble, or assemble, a filter unit to or from a transfer or aspirating pipette. Such a filter/pipette unit can be cumbersome to manipulate by the user, and can be of significant cost to the manufacturer to assemble and provide. The claimed device provides a simple-to-use, inexpensive, easy-to-manufacture alternative, which provides a sufficiently filtered specimen to a diagnostic device. By altering only the filter media, a wide range of analyses can be handled.

SUMMARY OF THE INVENTION

In accordance with the present invention, there is provided a pipette and a method of using the pipette for obtaining and treating fluid samples, for example, urine, for testing. The pipette of the present invention includes a flexible tube portion having an integrally formed squeezable bulb portion. The pipette further includes a spring clip arranged between the ends of the pipette.

The pipette is preferably formed from a polyethylene or other suitable plastic material capable of self-recovery from a distorted or collapsed shape. The tube portion of the pipette includes an inlet end or ingress and a metering end or egress.

The spring clip pinches together sidewalls of the tubular portion of the pipette approximately mid-length thereof. More specifically, the spring clip is longitudinally spaced between the bulb portion and the metering end of the pipette to inhibit air from aspirating into the pipette at the metering end.

The pipette further includes a filter arranged at the inlet end. The filter is preferably formed from fibrous polyester material, or a porous solid polyethylene or polypropylene media through which a sample fluid is permitted to pass.

In operation, the spring clip is arranged to pinch together the tubular portion of the pipette between the bulb portion and the metering end thereof. The bulb portion is collapsed and the filtered end of the pipette is dipped into the fluid to be tested. The bulb portion is then released to allow the fluid to aspirate into the pipette through the filter. The filtered fluid is cleaner than that obtained by a conventional pipette because it only passes through the filter in one direction.

Thereafter, the pipette is inverted and unfolded. The fluid is then dispensed from the metering end of the pipette. To facilitate dispensing of fluid sample from the pipette, the bulb portion may be slightly collapsed to create a slight pressure within the pipette.

The pipettes of the present invention provide many advantages. The pipettes are inexpensive, disposable, they provide an efficient controlled drop metering device and they allow the user to pass particulate containing fluids through a one way filter without the necessity of using a complex two-stage device.

DETAILED DESCRIPTION OF A PREFERRED EMBODIMENT

Figure 1:
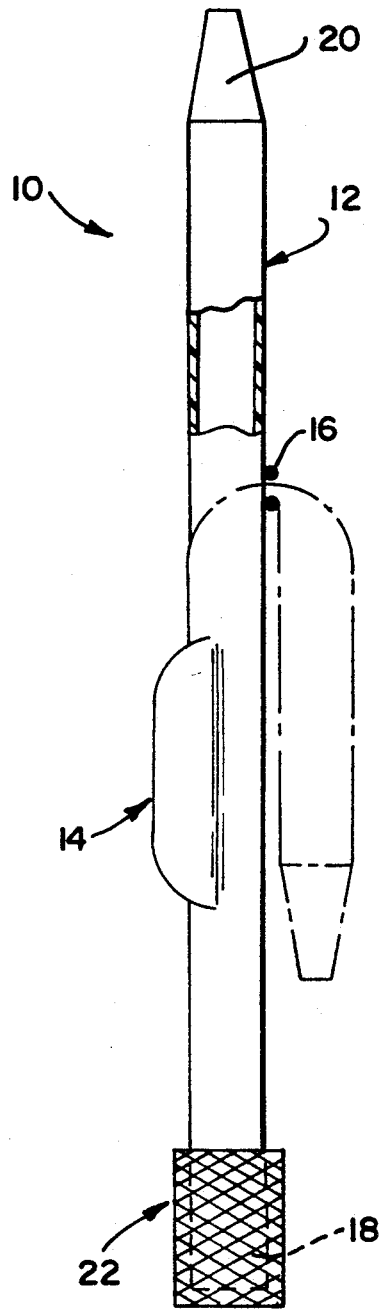
FIG. 1 is a schematic illustration of a pipette according to the present invention.

Referring now to the drawing, there is schematically illustrated a pipette 10. Pipette 10 includes a flexible tube portion 12 into which a fluid sample is aspirated and a squeezable bulb portion 14 for generating a change in pressure within the pipette 10. Pipette 10 further includes a spring clip 16 for inhibiting air from aspirating into the pipette when there is a change in pressure in the pipette.

Pipette 10 is preferably formed from polyethylene or another suitable plastic material capable of self-recovery from a distorted or collapsed shape. As illustrated, tube portion 12 of pipette 10 includes an inlet end or ingress 18 and a metering end or egress 20. Moreover, bulb portion 14 of pipette 10 is preferably formed as an integral part and between ends 18, 20 of the pipette 10.

Spring clip 16 may be of any suitable type capable of collapsing or pinching together sidewalls of the tubular portion 12 of pipette 10. As illustrated, spring clip 16 is operable approximately mid-length of the pipette between the ends of tubular portion 12. More specifically, spring clip 16 is longitudinally spaced between bulb portion 14 and metering end 20 to inhibit air from aspirating into the pipette at the metering end 20 upon change in pressure in the pipette resulting from squeezing or collapsing the bulb portion 14.

Pipette 10 further includes a filter 22 arranged at the inlet end or ingress of the pipette. The filter 22 is preferably formed from a polyester material through which a sample fluid is permitted to pass.

Upon operation, the pipette 10 is initially configured in a folded U-shape, as illustrated by dotted lines in FIG. 1. In such configuration, the aspirating leg portion of the folded pipette is longer than the metering leg portion thereof. The spring clip 16 is located between the bulb portion 14 and the metering end of the pipette 10.

After folding the pipette in a U-shape, the aspirating end of the pipette is dipped into the fluid to be tested. The bulb portion of the pipette is collapsed to generate a negative pressure sufficient to allow a fluid sample to aspirate into the tubular portion 12 of the pipette 10. The spring clip 16 located between the ends of the pipette effectively pinches together the tubular portion 12 in a manner inhibiting air from aspirating into the pipette from the metering end 20.

After the fluid sample is aspirated into the tube portion 12, the pipette is inverted and unfolded from its U-shape and the spring clip 16 is released. As will be understood, release of the spring clip allows the fluid sample to be dispensed from the metering end 20 of the pipette. To facilitate dispensing of the fluid sample from the pipette, the bulb portion 14 may be slightly collapsed after the pipette is unfolded and the spring clip is released.

Many diagnostic tests on urine require prior filtration. Accordingly, when the fluid sample to be aspirated into the pipette is urine, it is desirable to provide filter 22 at the aspirating end of the pipette. The filtered fluid is much cleaner because it only passes through the filter 22 in one direction.

This invention has been described in terms of a specific embodiment set forth in detail. It should be understood, however, that this embodiment is presented by way of illustration only, and that the invention is not necessarily limited thereto. Modifications and variations within the spirit and scope of the claims that follow will be readily apparent from this disclosure, as those skilled in the art will appreciate.

What is claimed is:

1. A method for withdrawing a fluid sample from a source fluid of comprising the steps of:

providing a pipette which is initially configured in a folded U-shape and comprises a flexible and foldable tube portion having an aspirating end and a metering end, means for generating a change in pressure within said tube portion, and means for inhibiting air from aspirating into the metering end of said pipette upon a change in pressure within said tube portion;

placing the aspirating end of the pipette in fluid communication with the source of fluid;

engaging the inhibiting means to prevent air from aspirating into the metering end;

establishing a negative pressure within said tube sufficient to allow a fluid sample to aspirate into the aspirating end of said tube portion while said inhibiting means are engaged;

unfolding the pipette;

inverting the pipette so that the metering end is at a lower elevation than the aspirating end; and releasing said inhibiting means to allow the fluid sample to be dispensed from the metering end thereof.

2. The method according to claim 1 further comprising the steps of filtering through filter means the fluid sample drawn into said pipette.

3. The method according to claim 2 wherein the fluid sample passes through said filter means in essentially only one direction.

4. A method for withdrawing and filtering a fluid sample from a source of fluid comprising:

pinching a resilient, flexible tube having integrally formed bulb means to distort the flexible tube into a collapsed shape and so define an inlet tube portion including an inlet end, and an outlet tube portion, isolated from the inlet tube portion, which terminates in an open outlet end;

dipping the inlet end into the source of fluid;

generating a negative pressure in the inlet tube portion by operation of said bulb means sufficient to draw the fluid sample into the inlet end while the flexible tube is distorted into a collapsed shape;

filtering the fluid sample as it is drawn into the inlet end;

inverting the flexible tube so that the open outlet end is at a lower elevation than the inlet end;

releasing the flexible tube and allowing the flexible tube to recover from the collapsed shape; and dispensing the fluid sample from the open outlet end.

* * * * *